US009273940B2

(12) United States Patent
Sexton

(10) Patent No.: US 9,273,940 B2
(45) Date of Patent: Mar. 1, 2016

(54) GUN FIRING METHOD FOR THE SIMULTANEOUS DISPERSION OF PROJECTILES IN SQUARE PATTERN

(71) Applicant: Richard Frank Sexton, Miami, FL (US)

(72) Inventor: Richard Frank Sexton, Miami, FL (US)

( * ) Notice: Subject to any disclaimer, the term of this patent is extended or adjusted under 35 U.S.C. 154(b) by 0 days.

(21) Appl. No.: 14/194,829

(22) Filed: Mar. 3, 2014

(65) Prior Publication Data

US 2015/0053107 A1 Feb. 26, 2015

Related U.S. Application Data

(60) Provisional application No. 61/851,228, filed on Mar. 4, 2013.

(51) Int. Cl.
*F42B 5/03* (2006.01)
*F42B 12/56* (2006.01)
*F42B 12/60* (2006.01)

(52) U.S. Cl.
CPC . *F42B 5/03* (2013.01); *F42B 12/56* (2013.01); *F42B 12/60* (2013.01)

(58) Field of Classification Search
CPC ..... F42B 5/03; F42B 12/56; F42B 12/58; F42B 12/60; F42B 12/62; F42B 12/64; F42B 30/02; F42B 33/00; F42B 33/001
USPC ..... 102/438, 439, 501, 506, 517
See application file for complete search history.

(56) References Cited

U.S. PATENT DOCUMENTS

| | | | | | |
|---|---|---|---|---|---|
| 90,732 | A * | 6/1869 | Curtis | 102/506 |
| 122,620 | A * | 1/1872 | Maduell | 102/506 |
| RE4,814 | E * | 3/1872 | Maduell | 102/506 |
| 216,974 | A * | 7/1879 | Rice | 102/506 |
| 221,249 | A * | 11/1879 | Nowlan | 102/506 |
| 588,764 | A * | 8/1897 | Boss | 102/436 |
| 620,875 | A * | 3/1899 | Baker | 102/506 |
| 1,203,649 | A * | 11/1916 | Papuga | 102/456 |
| 3,097,603 | A * | 7/1963 | Harper | 102/506 |
| 3,146,673 | A * | 9/1964 | Reed | 89/126 |
| 3,855,931 | A * | 12/1974 | Dardick | 102/436 |
| 7,017,495 | B2 * | 3/2006 | Sexton | 102/439 |
| 7,845,281 | B2 * | 12/2010 | Sexton | 102/439 |
| 8,141,493 | B1 * | 3/2012 | Kuchman | 102/439 |
| 9,103,640 | B2 * | 8/2015 | Sexton | F42B 5/03 |
| 2013/0255526 | A1 * | 10/2013 | Sexton | 102/506 |

* cited by examiner

*Primary Examiner* — James S Bergin

(57) ABSTRACT

A gun firing method whereby four projectile segments that are contained in a cartridge case are fired simultaneously which creates a predetermined square pattern on a target to increase the hit probability of the dispersion. Two sets of projectile segments that are contained in the cartridge case, are fired by a gun, spin around the central longitudinal axis of each projectile segment, and provide a powerful square salvo of projectile segments. The dispersion produces a substantial increase in the hit probability when compared to a single shot.

6 Claims, 3 Drawing Sheets

PISTOL HIT PROBABILITY

1 SHOT VS 4 PROJECTILE SQUARE SALVO 39.5 MILS (RMS) AIMING ERROR - REGULAR SOILDER - 1.4 SEC. TARGET EXPOSURE TIME *

PROBABILITY OF MISSING THE TARGET

1 SHOT VS 4 PROJECTILE SQUARE SALVO

GUN FIRING METHOD FOR THE SIMULTANEOUS DISPERSION OF PROJECTILES IN SQUARE PATTERN

CROSS-REFERENCE TO RELATED APPLICATIONS

This application claims the benefit of provisional patent application Ser. No. 61/851,228, filed 2013, Mar. 4 by the present inventor.

BACKGROUND ART

With the advent of guns and firearms much effort has been devoted to their perfection in the art of firing projectiles to hit specified targets. An important factor relating to the firing of a gun is the hit probability of the weapon.

A shotgun increases the hit probability by firing multiple projectiles in a random dispersion. An automatic weapon increases the hit probability by firing a random dispersion of projectiles toward a target, thereby covering a broad area around a target and assuring a greater chance of striking the target. Multiple projectiles can be fired simultaneously from a rifle or handgun to increase the hit probability of the weapon.

Much of the prior art for multiple projectile segment cartridges that fire multiple projectiles simultaneously from a single cartridge is from the late 1800's. Nolan (U.S. Pat. No. 221,249 Filed November 1879) uses a multiple projectile segment projectile. Most of the projectile segments that are side by side are held together temporarily after firing by "caps with spurs", "or soldering" on the forward pointed end, and a "beveled flange" on the aft end. The width of the dispersion is regulated somewhat by the deceleration of the projectile and the resulting force between the forward segments and the aft full caliber projectile segment which separate in flight. "The projectile can be used in either muzzle loading or breech loading arms . . . "

Rice (U.S. Pat. No. 216,974 Filed July 1879) uses a multiple projectile segment cartridge where pointed projectile segments are side by side. However, Rice apparently uses a smooth bore gun. The cartridge has a "conical or equivalent opening left at the point" and the projectile segments "move in different courses because of their particular shape and because of the action of the air, which spreads them apart as they are shot through it."

Both of these patents are similar to the applicant's invention, in that multiple projectile segment are fired. However the methods used in these patents, such as "caps with spurs" or "conical or equivalent opening left at the point," will not fire the projectile segments in accurate repeatable symmetrical patterns compared to the applicant's invention, or be as efficient in hitting the target with projectile segments that retain their velocity, and have a high sectional density because they are spinning around their fore and aft axis, which causes significantly higher terminal effects.

In 1952 a report for the U.S. Army by the Operations Research Office "Operational Requirements for an Infantry Hand Weapon" analyzed firing a salvo of 5 projectiles in a diamond shaped pattern, and found the concept would greatly increase the hit probability of a weapon. With the "pattern-dispersion principle" each projectile had a predetermined hit point in the dispersion, was separated from the other projectiles, and the diamond shaped salvo efficiently maximized the lethal area, and the hit probability of the dispersion. Graphs of the hit probability of the diamond shaped dispersion at different ranges and aiming errors, along probability tables that predicted the number of projectiles that would strike the target at a given range were included in the report.

Several multi-barreled weapons that fire projectiles simultaneously to form patterns were tested during Project Salvo (1952-1962). These weapons were discontinued after Project Salvo. These weapons failed to provide a solution to the long felt need of simultaneously firing a salvo of projectiles in a pattern.

The U.S. Army determined that the "pattern salvo weapon" or "dispersion weapon" would be very effective and recommended that the Ordinance Corp. proceed to develop a pattern salvo weapon for the Infantry. It was assumed that a weapon would be produced, and in "Operational Requirements" (pages 31-32) the "Basis of Issue" for the "dispersion weapon" that was recommended was " . . . 7 in every 10 infantry hand weapons should have the characteristics desirable for short range use." However a practical "dispersion weapon" that fired the 5 shot diamond shaped pattern was never developed.

SUMMARY OF THE INVENTION

This invention concerns taking a two projectile salvo and adding another two projectile salvo. The result is a four projectile segment cartridge that fires four projectile segments in a square salvo of projectiles at the target. The predetermined square salvo consists of four projectile segments that spin around the central longitudinal axis of each projectile segment, and strike the target. The salvo greatly increases the hit probability of the dispersion when compared to a single shot. The symmetrical square salvo of projectiles is rotationally randomly oriented around the central aim point.

With the present invention 4 projectile segment square salvos with a random rotational orientation of the pattern can be fired from rifles and handguns at relatively short ranges to substantially increase the hit probability of the gun. All the projectile segments in the revolver cartridge spin around the central longitudinal axis of each projectile segment after exiting the gun barrel.

In some cases graphite, or a thin disk of Teflon between the two projectile segments 3, and the two projectile segments 2, was found to promote the projectile segments to spin around the central longitudinal axis of each projectile segment.

The energy available by firing a rifle, or a more powerful handgun, can be efficiently used by firing 4 projectile segments in a wide square pattern, to greatly increase the hit probability of the gun. A square salvo of projectile segments will compensate somewhat for imprecise aiming. Random rotational orientation of the 4 projectile segment square pattern is produced by firing the multi-projectile segment cartridges.

A wide square pattern can be fired from a rifle or handgun to substantially increase the hit probability of the weapon in defensive situations that necessarily require fast reactions. Rifles and handguns that are used for personal defense are fired with short target exposure times and large aiming errors. (1) The average aiming error for these short target exposure times can be taken into account, and an optimal dispersion in which the standard radial deviation of the dispersion is 50%-100% of the aiming error can be fired.(2)

Many rifles and handguns will fire salvos generally within this optimal dispersion. Hit probability increases for the pattern dispersion salvos vary widely with the number of projectiles in the salvo, range, and aiming error, but many rifles and handguns, fired quickly in a defensive situation, will have on the order of a 60%-100% or more increase in hit probability by firing a pattern dispersion salvo compared to firing a single shot.(3)

Handguns are difficult to fire effectively. (In a study over an 8 year period the N.Y. Police hit their target only 18% of the time in shooting situations.) Rand Report.

Footnote 1 "Rifle, Carbine, and Pistol Aiming Error as a Function of Target Exposure Time" 1955 report by the Operations Research Office for the U.S. Army.

Footnote 2 "Hit Probability on a Tank Type Target" 1966 report by the Frankford Arsenal. The report indicates the size of a dispersion to maximize the hit probability for a salvo of projectiles.

Footnote 3 "Operational Requirements for an Infantry Hand Weapon" has graphs of hit probabilities of a diamond shaped pattern dispersion salvo compared to one shot for several aiming errors. These graphs can be adjusted for the wider dispersions and shorter ranges of the present invention.

DETAILED DESCRIPTION OF THE INVENTION

The invention represents a device and method for creating a symmetrical 4 projectile segment square pattern of projectile strikes on a target to increase the hit probability of a gun.

Figure 1:
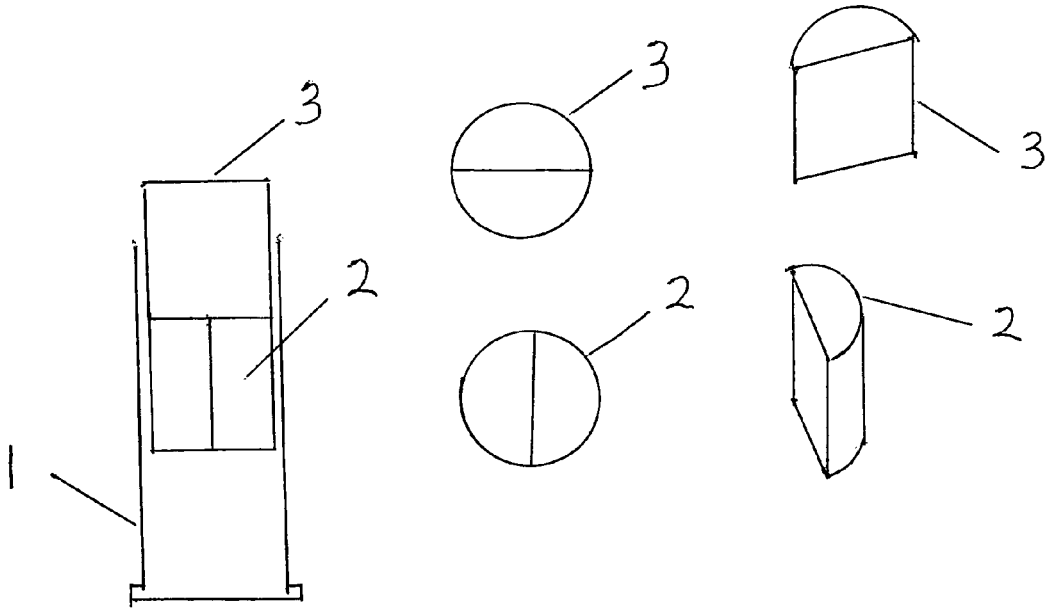
FIG. 1 is a side view of a 4 projectile segment cartridge.

FIG. 1 reveals a 4 projectile segment cartridge. Cartridge case 1 contains two projectile segments that are positioned side by side in cartridge case 1. Two addition projectile segments 3 are positioned side by side and forward of the two projectiles segments 2 and at approximately 90 degrees rotational orientation to projectile segment 2.

Figure 2:
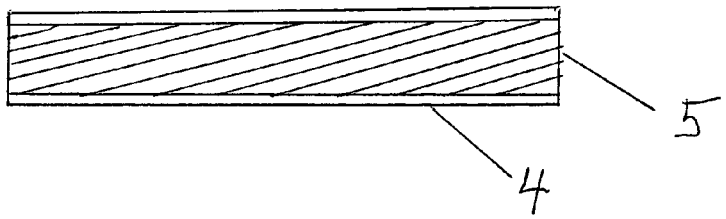
FIG. 2 is a depiction of a rifled gun barrel.

FIG. 2 depicts a rifled gun barrel 4 with rifling 5. When a 4 projectile segment cartridge 1 is fired through gun barrel 4 the two projectile segments 2 push the two projectile segments 3. The two projectile segments 2 along with the two projectile segments 3 have a center of mass that is not on the central axis of the gun barrel. When the two projectile segments 2 and the two projectile segments 3 are fired, the centrifugal force from the projectile segments spinning in gun barrel 4 because of the rifling 5 imparts a force on the projectile segments at 90 degrees to the central axis of gun barrel 4. Upon exiting the gun barrel this velocity along with a much higher muzzle velocity determines how far away from the aim point the projectile segments will strike.

After firing, the four projectile segments will rotate around the central longitudinal axis of gun barrel 4. While on the central longitudinal axis of gun barrel 4 the four projectile segments will be rotating around an axis that coincides with the flat side surface of each projectile segment. Each of the projectile segments 3 will exit the end of gun barrel 4 where the axis of rotation of the two projectile segments 3 will change to the central longitudinal axis of each projectile segment 3. The two projectile segments 3 will travel in a path that will strike the target on either side of the central aim point. The two projectile segments 2 will follow the two projectile segments 3 from the end of gun barrel 4, and the axis of rotation of the two projectile segments 2 will change to the central longitudinal axis of each projectile segment 2. The two projectile segments 2 will strike the target in an orientation that is 90 degrees to the two projectile segment 3 projectiles. The result is a symmetrical square pattern of four projectile segment strikes on the target. The square pattern will be randomly rotationally oriented.

The projectile segments imprint a half moon shape on the target. The size of the pattern will depend on the twist of the barrel, the diameter of the projectile, and the range of the target.

A 44 Magnum revolver with a 1-20 twist will fire 4 90 grain projectile segments in an approximately 5¼ inch square pattern at 10 feet. The energy of the projectile segments from a 4 inch 44 Magnum is approximately 800 ft. lbs.

A 480 Ruger revolver with a 1-18 twist will fire 4 115 grain projectile segments in an approximately at 6½ inch square pattern at 10 feet.

A 545 Casull revolver will fire a powerful square salvo at 10 feet that is 5 inches square, and a 44 Magnum rifle with a 1-30 twist will fire a 3½ inch square pattern a 10 feet.

Figure 3:
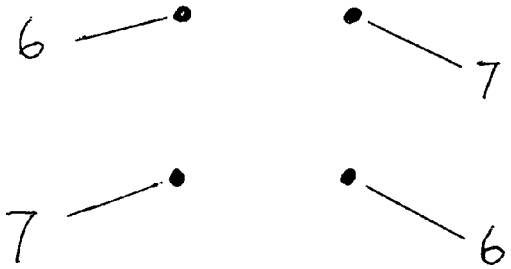
FIG. 3 is a square pattern of projectile strikes on a target.

FIG. 3 is a square pattern of projectile strikes on a target. The square pattern is randomly rotationally oriented. Two projectile segments 3 from cartridge 1 strike the target at the two strike points 6 in FIG. 3. The two projectile segments 2 from cartridge 1 strike the target at the two strike points 7 in FIG. 3. The aim point is in the center of the square pattern.

Figure 4:
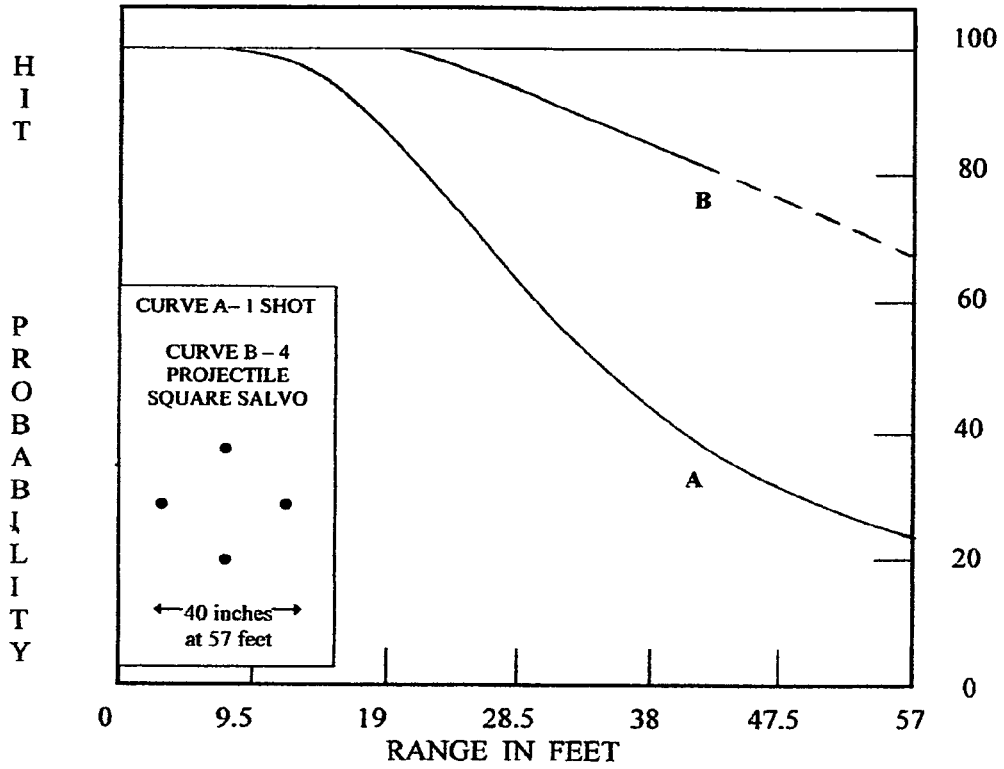
FIG. 4 is a graph of the hit probability of a square salvo from a 44 Magnum revolver based on U.S. Army reports.

FIG. 4 is a graph of the hit probability of a 44 Magnum revolver firing a single shot versus firing a 4 projectile segment square pattern at the target at a specific aiming error. The aiming error graphs of Army personnel for specific target exposure times were taken into account to construct the graph in FIG. 4 (Source—"Rifle, Carbine, and Pistol Aiming Errors as a Function of Target Exposure Times" Operational Research Office 1955). The graph in FIG. 4 is based on U.S. Army graphs from "Operational Requirements" and is adjusted for range. It was determined that a random rotational orientation of the square pattern would have substantially the same hit probability as the diamond shape from the report. It was stated in the Army report that the hit probability for the diamond shape salvo with a central round in the center (5 projectiles) was the same as the hit probability of the 4 outside projectiles as long as the salvo was less than 30 inches in width which translates to a distance of 43 feet for the 44 Magnum revolver. The target is a Type E Silhouette Target—660 sq.in.

Figure 5:
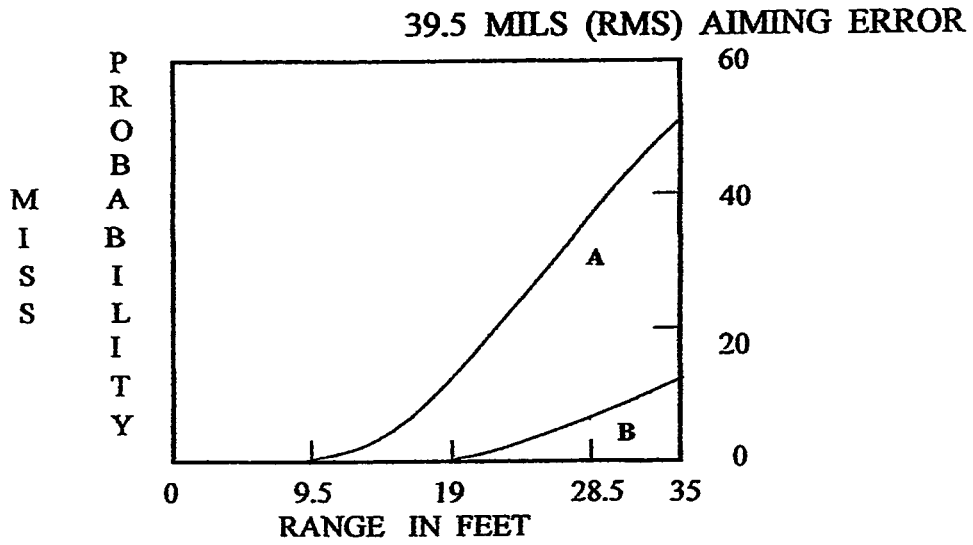
FIG. 5 consists of 2 graphs which show the miss probability for 1 shot compared to firing a square salvo at 2 different aiming errors, based on U.S. Army reports.
Figure 5:
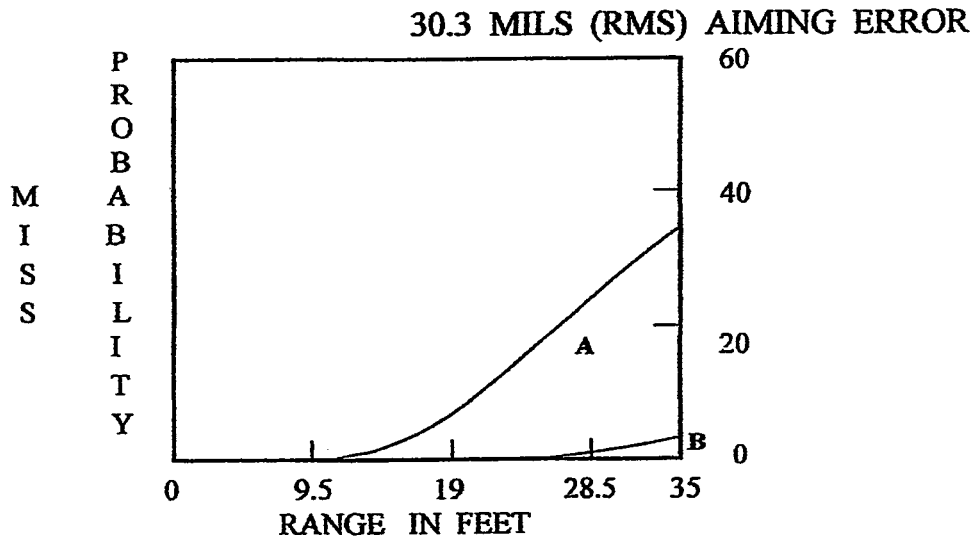

FIG. 5 consists of 2 graphs which show the probability of missing the target at two different aiming errors. Each graph shows the miss probability for 1 shot versus a 4 projectile square salvo. By comparing area A and area B on each of the graphs, the reduction in misses by firing a square salvo of projectiles compared to a single shot can be determined.

Top graph 39.5 MILS AIMING ERROR—Regular Soldier 1.4 sec. target exposure time $$\frac{\text{Area } A}{\text{Area } B} = \frac{6}{1}$$

6 Fold Reduction in misses on the target 0-35 ft.

Bottom graph 30.3 MILS RMS AIMING ERROR $$\frac{\text{Area } A}{\text{Area } B} = \frac{20}{1}$$

20 Fold Reduction in misses on the target 0-35 ft.

The 6 fold, and 20 fold reduction in misses on the target from the 2 graphs in FIG. 5 points out that someone who uses a handgun for home-defense or self-defense will have a clear advantage by firing a square salvo if they ever have to use their gun to defend themselves.

The square projectile segment salvos in the applicant's invention produces a significantly greater hit probability than the combined hit probability of two randomly oriented 2 projectile salvos.

At a certain range and aiming error a vertical two shot dispersion has an added hit probability of approximately 0.3 over a single shot on a silhouette target, and a horizontal two shot dispersion has an added hit probability of approximately 0.7 over a single shot. A square pattern as in the applicant's invention would have an added hit probability of 0.3+0.7=1. The added hit probability would be added to the hit probability of a single shot to arrive at a hit probability of 2.0 for the square salvo.

For comparison if two 2 projectile salvos were fired at the same time and at the same aim point but they were each randomly oriented, the pattern created on the target would vary between both 2 projectile segment salvos striking the target at the same rotational orientation and a square when the two shot salvos hit the target with a 90 degree rotational orientation between them. The total hit probability of the two 2 projectile salvos that are each randomly oriented would vary between 1.3 for the two salvos striking the target vertically to 2.0 for the two randomly oriented separate 2 projectile salvos projecting a square pattern on the target.

The applicant's invention combines two 2 projectile salvos together to form a square pattern with a consistent hit probability of 2.0. In contrast, two randomly oriented 2 projectile salvos will have varied hit probability of between 1.3 to 2.0.

There is an added function to one of the elements in the applicant's invention. The cartridge case usual function is to hold a projectile or projectiles. The cartridge case in the applicant's invention has the added function of providing rotational orientation for two independent 2 projectile segment salvos which now strike the target in a square pattern.

Additionally, the arrangement of projectiles in the cartridge case permits a maximum weight of projectiles to be fired. The flat frontal area of the 4 projectiles or the melplats on the projectile is double the frontal area of a single projectile. The melplat is important for producing good terminal effects for the projectiles.

Four projectile segment ammunition is particularly well suited to revolvers since the cylinder shaped 2 projectile segments that are forward of the cartridge case can be easily loaded into the cylinder of a revolver.

The 4 projectile ammunition also feeds reasonably well in a lever action 44 Magnum rifle. The profile of the two forward projectile segments would have to be altered for use in semi-automatic weapons.

The cartridge case holds the two projectile salvos in a rotational orientation that can be varied but approximately 90 degrees is necessary for a square salvo. If the twist of the barrel is taken into account for a 44 Magnum revolver 81 degrees between the salvos is optimum. The pattern on the target will vary from a very symmetrical square pattern to a slightly rectangular pattern.

A 5 projectile square salvo pattern with a central projectile has an equal hit probability as the applicant's 4 projectile square salvo up to a 30 inch width for the salvo (Infantry Requirements). This 30 inch width is reached at 43 feet for a 4 projectile square salvo from a 44 Magnum revolver with a 1-20 twist. This range is approximately double that of the 7 yard average for handguns that are actually used in self defense.

The projectile segments that are side by side in the cartridge case spin around their the central longitudinal axis of each projectile segment after leaving the gun barrel and continue to spin around their the central longitudinal axis of each projectile segment after striking ballistic gelatin(4), which allows them to penetrate at least 14 inches with a 44 magnum revolver. The number of revolutions of the projectile segments as they passed through the ballistic gelatin is easily observed through most of the projectile segment's path.

Footnote 4 The 10% gelatin that was used was substantially the same as ballistic gelatin that is commercially available.

The invention claimed is:

1. A system for projectile dispersion to improve the hit probability on a target comprising:

a gun having a rifled barrel;

a projectile having a main body, having a front end, a back end and a side, positioned within a cartridge case;

wherein said projectile is divided into four projectile segments;

wherein a first two of said projectile segments are arranged side by side in said cartridge case;

wherein a second two additional said projectile segments are arranged side by side in said cartridge case in front of said first two projectile segments and rotationally oriented at approximately 90 degrees to said first two projectile segments;

whereby four said projectile segments consisting of two pairs of said projectile segments that are arranged side by side contained in said cartridge case create a square pattern of four said projectile segments on the target that is randomly rotationally oriented when the four of said projectile segments are fired simultaneously by said gun on said target.

2. The system of claim 1 wherein;

in combination the arranged side by side said projectile segments and a means of providing the arranged side by side said projectile segments to spin around the central longitudinal axis of each projectile segment after exiting the gun barrel.

3. The system of claim 1 wherein;

side by side arranged said projectile segments have substantially flat ends whereby each said projectile segment spins around the central longitudinal axis of each projectile segment after exiting said gun barrel.

4. A method for projectile dispersion to improve the hit probability on a target comprising; providing gun having a rifled barrel;

providing said projectile having a main body, having front end, back end and a side positioning within cartridge case;

dividing said projectile into four projectile segments;

arranging a first two of said projectile segments side by side in said cartridge case;

additional arranging a second two of said projectile segments side by side in said cartridge case in front of first said two projectile segments and rotationally orienting the second two said projectiles at approximately 90 degrees to said first two projectile segments;

firing simultaneously from said gun four said projectile segments that are arranged side by side in said cartridge case to create a square pattern of four said projectile segments on the target that is randomly rotationally oriented when four said projectile segments are fired simultaneously by said gun on said target.

5. A method as recited in claim 4 wherein;

combining the arranged side by side said projectile segments and a means for providing the arranged side by side said projectile segments to spin around the central longitudinal axis of each projectile segment after exiting said gun barrel.

6. A method as recited in claim 4 wherein;

providing side by side arranged said projectile segments with substantially flat ends whereby each said projectile segment spins around the central longitudinal axis of each projectile segment after exiting said gun barrel.

* * * * *